US011759380B2

(12) United States Patent
Foster

(10) Patent No.: US 11,759,380 B2
(45) Date of Patent: Sep. 19, 2023

(54) HOSPITAL BED WITH FOOT EGRESS

(71) Applicant: Leslie Dale Foster, Guilford, IN (US)

(72) Inventor: Leslie Dale Foster, Guilford, IN (US)

(73) Assignee: Safe Harbor Hospital Beds, LLC, Greendale, IN (US)

( * ) Notice: Subject to any disclaimer, the term of this patent is extended or adjusted under 35 U.S.C. 154(b) by 0 days.

(21) Appl. No.: 17/966,058

(22) Filed: Oct. 14, 2022

(65) Prior Publication Data

US 2023/0157911 A1 May 25, 2023

Related U.S. Application Data

(60) Provisional application No. 63/302,342, filed on Jan. 24, 2022, provisional application No. 63/255,928, filed on Oct. 14, 2021.

(51) Int. Cl.

| | |
|---|---|
| ***A61G 7/015*** | (2006.01) |
| ***A61G 7/053*** | (2006.01) |
| ***A61G 7/075*** | (2006.01) |
| ***A61G 13/08*** | (2006.01) |
| ***A61G 13/12*** | (2006.01) |

(52) U.S. Cl.

CPC ..... *A61G 7/015* (2013.01); *A61G 7/053* (2013.01); *A61G 7/0755* (2013.01); *A61G 13/08* (2013.01); *A61G 13/125* (2013.01)

(58) Field of Classification Search

CPC ..... A61G 7/015; A61G 7/053; A61G 7/0755; A61G 7/16; A61G 13/08; A61G 13/1245; A61G 13/125; A47C 20/021; A47C 20/022

USPC ..... 5/619, 624, 648

See application file for complete search history.

(56) References Cited

U.S. PATENT DOCUMENTS

| | | | | |
|---|---|---|---|---|
| 1,398,203 A | | 11/1921 | Schmidt | |
| 2,308,592 A | | 1/1943 | Drexler et al. | |
| 3,138,805 A | | 6/1964 | Piazza | |
| 3,284,126 A | | 11/1966 | Piazza | |
| 4,314,735 A | | 2/1982 | Fullenkamp et al. | |
| 4,411,035 A | | 10/1983 | Fenwick | |
| 4,639,954 A | * | 2/1987 | Speed | A61G 13/00 5/602 |
| 4,787,104 A | | 11/1988 | Grantham | |

(Continued)

OTHER PUBLICATIONS

LeLaurin, Jennifer, H. et al., "Preventing Falls in Hospitalized Patients: State of the Science", HHS Public Access, Author manuscript, Clin Geriatr Med. May 2019; 35(2): 273-283. doi:10.1016/j.cger.2019.01.007 (12 pages).

(Continued)

*Primary Examiner* — Robert G Santos

(74) *Attorney, Agent, or Firm* — Ronald J. Richter; Nesbitt IP LLC

(57) ABSTRACT

A hospital bed having foot egress, including a foot section with a pair of foot panels that can pivot upward and be locked into place to provide a support structure for standing and ambulation. Each of the pair of foot section panels can include a grab handle for assistance in standing. The foot end of the frame of the bed includes a retractable crossbar which supports the foot panels, and which can be reversibly retracted towards the middle of the bed frame and beneath the seat section of the bed to provide a clearing at the distal foot end of the bed for the patient to stand and exit the bed safely and efficiently.

18 Claims, 7 Drawing Sheets

(56) References Cited

U.S. PATENT DOCUMENTS

| | | | | |
|---|---|---|---|---|
| 4,862,529 | A | 9/1989 | Peck | |
| 4,894,876 | A * | 1/1990 | Fenwick | A61G 13/0009 5/602 |
| 4,985,946 | A | 1/1991 | Foster et al. | |
| 5,054,141 | A | 10/1991 | Foster et al. | |
| 5,077,843 | A | 1/1992 | Foster et al. | |
| 5,083,332 | A | 1/1992 | Foster et al. | |
| 5,095,561 | A | 3/1992 | Green et al. | |
| 5,179,744 | A | 1/1993 | Foster et al. | |
| 5,226,187 | A | 7/1993 | Borders et al. | |
| 5,398,357 | A | 3/1995 | Foster | |
| 5,454,126 | A | 10/1995 | Foster et al. | |
| 5,479,666 | A | 1/1996 | Foster et al. | |
| 5,577,279 | A | 11/1996 | Foster et al. | |
| 6,112,345 | A | 9/2000 | Foster et al. | |
| 6,163,903 | A | 12/2000 | Weismiller et al. | |
| 6,374,436 | B1 | 4/2002 | Foster et al. | |
| 6,694,548 | B2 | 2/2004 | Foster et al. | |
| 6,725,474 | B2 | 4/2004 | Foster et al. | |
| 6,754,923 | B2 | 6/2004 | Borders et al. | |
| 8,104,122 | B2 | 1/2012 | Richards et al. | |
| RE43,155 | E | 2/2012 | Allen et al. | |
| RE43,532 | E | 7/2012 | Menkedick et al. | |
| 8,474,076 | B2 * | 7/2013 | Hornbach | A61G 7/0755 5/624 |
| 8,495,774 | B2 | 7/2013 | Soltani | |
| 8,522,379 | B2 | 9/2013 | Turner | |
| 8,615,827 | B2 * | 12/2013 | Newkirk | A61G 7/0755 5/619 |
| 9,205,012 | B2 | 12/2015 | Hillenbrand, II et al. | |
| 9,248,064 | B2 | 2/2016 | Hillenbrand, II et al. | |
| 10,137,045 | B2 | 11/2018 | Hillenbrand, II et al. | |
| 10,188,567 | B2 | 1/2019 | Wurdeman | |
| 10,314,754 | B2 | 6/2019 | Karwal et al. | |
| 11,052,005 | B2 | 7/2021 | Childs et al. | |
| 11,116,680 | B2 | 9/2021 | Derenne et al. | |
| 2006/0070182 | A1 | 4/2006 | Heimbrock et al. | |
| 2010/0223727 | A1 * | 9/2010 | Newkirk | A61G 7/0755 5/602 |
| 2012/0198629 | A1 * | 8/2012 | Hornbach | A61G 7/0755 5/624 |
| 2016/0193095 | A1 | 7/2016 | Roussy et al. | |
| 2018/0064592 | A1 | 3/2018 | Sweeney et al. | |
| 2023/0157911 | A1 * | 5/2023 | Foster | A61G 7/015 5/619 |

OTHER PUBLICATIONS

International Search Report and Written Opinion dated Feb. 2, 2023 for related International Application No. PCT/US2022/046673 filed Oct. 14, 2023 (10 pages).

* cited by examiner

HOSPITAL BED WITH FOOT EGRESS

CROSS-REFERENCE TO RELATED APPLICATION

This application claims the benefit of U.S. Provisional Application No. 63/302,342 filed Jan. 24, 2022, and U.S. Provisional Application No. 63/255,928 filed Oct. 14, 2021, the disclosures of which are incorporated by reference herein in their entirety.

FIELD OF THE INVENTION

The present invention relates in general to hospital beds, and more particularly to a hospital bed which can provide a clearing for egress from the foot end of the bed while providing support for standing and ambulation.

BACKGROUND OF THE INVENTION

Inpatient falls are a common and devastating complication of hospital care, particularly in elderly patients. Patients attempting to stand on their own often suffer slips, falls and serious injuries such as fractures and head trauma. It has been estimated that 700,000 to 1 million hospitalized patients fall each year, resulting in 250,000 injuries and up to 11,000 deaths. Patients in long-term care facilities are also at very high risk of falls, with approximately 1.3 million nursing home residents in the United States falling each year. Fall prevention measures such as alarm systems, nonslip socks or floors, sitters for keeping patients within line of sight, and lowering the bed height are all useful aspects of a fall prevention program; nevertheless, fall prevention remains the focus of intensive research efforts.

Patients are often required to sit up in bed prior to transferring to a wheelchair or walker, such as elderly or post-surgical patients. For example, a patient having undergone hip or knee replacement is typically urged to move from the bed to a walker on the same day of their surgical procedure; a typical goal for open heart patients is to be sitting up in a chair on the second day following surgery, and abdominal surgery patients are encouraged to be standing at the bedside the first day after surgery. Indeed, the ability to sit up and stand on one's own is an important component of physical and/or occupational therapy, and often the patient will not be cleared to leave the hospital until they are able to exit the hospital bed unassisted.

While early ambulation is typically a goal for hospitalized patients, it may be a difficult task, since such movements can be painful and may cause dizziness or disorientation. Conventional hospital beds typically provide individualized support to the patient's head, torso, legs, and feet. Also, one or more sections of the bed may be able to be moved or re-oriented relative to another to facilitate patient mobility. Nevertheless, to sit up in a typical, conventional hospital bed, a supine patient must first re-orient their body by rolling to one side. The nurse can assist in raising the head of the bed, if needed, to get the patient's torso upright. The patient must then swing their feet around and drop their legs over the side of the bed, and in order to stand they must move their legs and feet away from the bed to bring their feet into contact with the floor. They must then support themselves on their legs, get balanced, and stand up out of the bed. This process can be painful and challenging, and unfortunately it is still common for patients to fall and injure themselves during the process, which increases the length of their hospital stay.

Hospital bed mechanisms for assistance in early ambulation are well known in the art, and may be electrically, hydraulically, and/or pneumatically operated. Some beds have been designed to assist patients in moving from a supine position to a sitting position and then to a standing position. However, while current hospital beds may provide several advantageous features and have generally performed well for their intended purposes, there remains a need for a hospital bed which can lower the risk of falls and reduce the pain of early ambulation while promoting improved patient mobility and safety.

SUMMARY OF THE INVENTION

Accordingly, the present invention provides significant improvements to known hospital beds which can enable patients to move more easily from a supine position to a sitting position, and from the sitting position to a standing position, for the purpose of achieving the standing or walking position in a more efficient and less painful manner.

A first aspect of the invention provides a hospital bed having foot egress, the bed comprising: (a) a frame, the frame including a first lateral rail, a second lateral rail, and a retractable crossbar; and (b) a patient support surface supported by the frame, the support surface including: (i) a back section, (ii) a seat section, and (iii) a foot section, the foot section comprising a first foot panel and a second foot panel, the first foot panel being pivotably connected to the first lateral rail and the second foot panel being pivotably connected to the second lateral rail, wherein the retractable crossbar is reversibly movable along the opposing lateral rails between an extended position in which the crossbar is beneath the foot section and a retracted position in which the crossbar is beneath the seat section, wherein the first foot panel and second foot panel are each upwardly pivotable from a substantially co-planar relationship to a substantially parallel relationship, and wherein a clearing for egress from the bed is exposed when the retractable crossbar is in the retracted position and the first and second foot panels are in the substantially parallel relationship.

A second aspect of the invention provides a hospital bed with foot egress, the bed comprising: a frame including a first lateral rail, a second lateral rail, and a retractable crossbar; and a patient support surface coupled to the frame and including a foot section comprising a first foot panel and a second foot panel, wherein each of the first foot panel and the second foot panel include a grab handle for assistance in standing and ambulation, wherein the retractable crossbar is reversibly movable along the frame from an extended position beneath the foot section to a retracted position beneath the seat section, and wherein the first foot panel and the second foot panel are each upwardly pivotable relative to the seat section and away from one another to expose a clearing for egress from the bed.

A third aspect of the invention provides a hospital bed having foot egress, the bed comprising: a frame, the frame including a retractable crossbar movable along a first lateral rail and a second lateral rail, the lateral rails opposing one another; and a patient support surface supported by the frame, the support surface including a back section, a seat section, a thigh section, and a foot section, the foot section comprising a first foot panel and a second foot panel, the first foot panel being pivotably connected to the first lateral rail and the second foot panel being pivotably connected to the second lateral rail, wherein the retractable crossbar is reversibly movable along the opposing lateral rails between an extended position in which the crossbar is beneath the foot section and a retracted position in which the crossbar is beneath the thigh section, wherein each of the first foot panel and the second foot panel are upwardly pivotable from a substantially co-planar relationship to a substantially parallel relationship when the retractable crossbar is in the retracted position, wherein each of the first foot panel and the second foot panel include a grab handle for assistance in standing and ambulation and are configured to lock into place after being pivoted to the substantially parallel relationship, and wherein a clearing for egress from the bed is exposed when the retractable crossbar is in the retracted position and the first and second foot panels are in the substantially parallel relationship.

The nature and advantages of the present invention will be more fully appreciated from the following drawings, detailed description, and claims.

BRIEF DESCRIPTION OF THE DRAWINGS

The accompanying drawings illustrate the prior art and preferred embodiments of the invention and, together with a general description of the invention given above, and the detailed description given below, explain the principles of the invention.

DETAILED DESCRIPTION OF THE INVENTION

Figure 1:
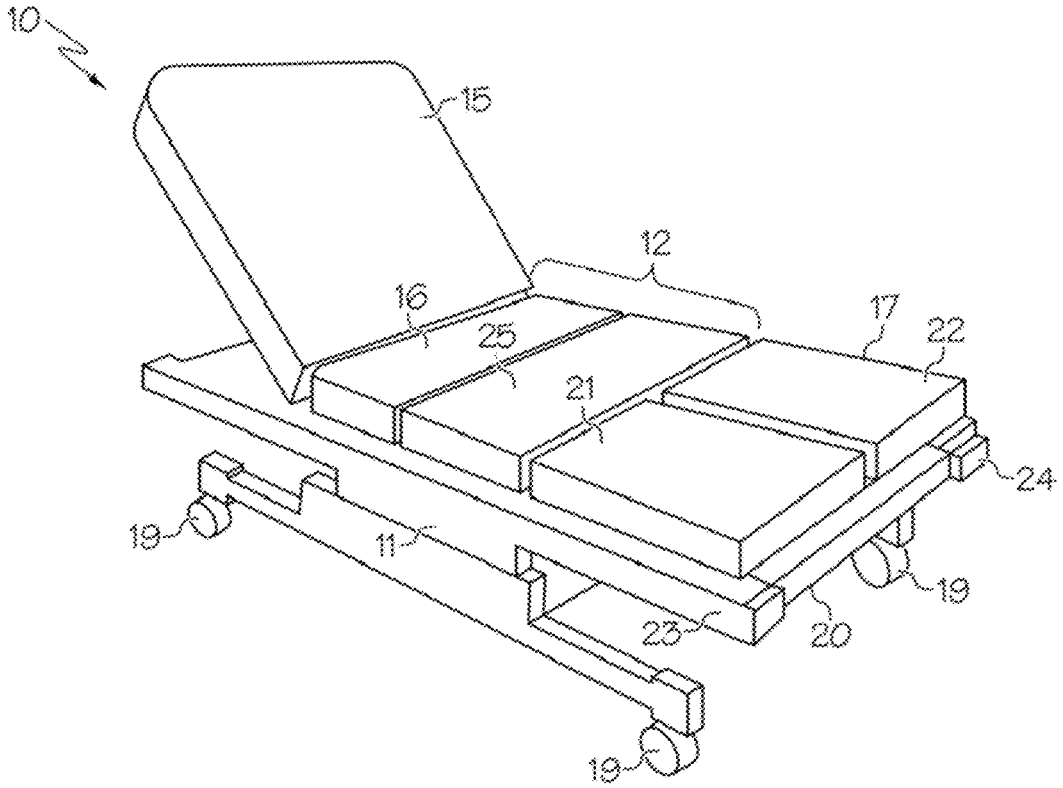
FIG. 1 illustrates a perspective view of one embodiment of a hospital bed according to the present invention.
Figure 2:
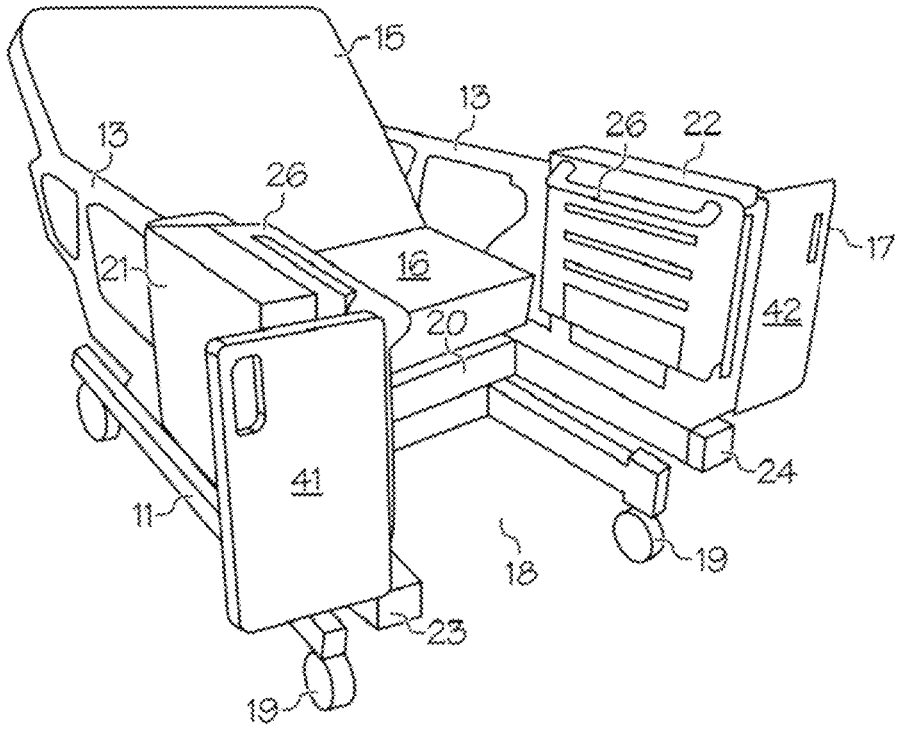
FIG. 2 illustrates a perspective view of a chair configuration of one embodiment of the hospital bed according to the present invention.

Referring initially to FIGS. 1 and 2, a hospital bed 10 according to the invention is shown including a base frame 11 and a patient support surface 12 mounted on the frame. Conventional guard rails 13 (or side rails, see FIG. 2) are typically located on each side of the back and/or seat sections 15, 16 of the bed, with a plurality of caster wheels 19 facilitating support and transportation. An intermediate frame (not shown) can also be supported by the base frame 11 and coupled to the patient support surface 12, as is known in the art. The patient support surface 12 is typically formed by a head/back section 15, a seat section 16, and a leg or foot section 17, which are mounted on the frame 11. A thigh section 25 can also be included, as is known in the art, for example, as part of the patient support surface 12 adjacent the seat section 16. The seat section 16 may be rigidly mounted to the frame 11 to prevent movement therebetween, while the thigh section 25 can be pivotably coupled or otherwise mobile.

In contrast, the foot section 17 is typically not pivotably attached to the adjacent seat section 16 (or the thigh section 25, if present), and instead includes a first foot panel 21 and a second foot panel 22, both of which are pivotably mounted on opposing first and second lateral rails 23, 24 at the foot end of the frame 11, with the first foot panel 21 being pivotably connected to the first lateral rail 23 and the second foot panel 22 being pivotably connected to the second lateral rail 24 at the foot end of the frame 11. Each of the foot panels 21, 22 are movable relative to the other, and they are also movable relative to the seat section 16, so that the foot section 17 of the bed can be "opened" as shown in FIG. 2 to provide a clearing 18 for the patient to stand and to exit from the foot of the bed efficiently and safely.

For the purposes of the present invention, the patient support surface 12 of the hospital bed can include either three or four sections, so long as there is the foot section 17, as described herein. The various sections 15, 16, 17, 25 of the patient support surface 12 can each include conventional molded foam pads or mattresses to provide a suitable soft, yet supportive surface upon which a patient can rest. Likewise, the foot section 17 including the first foot panel 21 and the second foot panel 22, can also be capped or topped with a molded foam pad or mattress. Fitted sheets can cover each of the various support surface sections, and when soiled or dirty they can be easily removed and replaced by the hospital staff.

The inventive hospital bed 10 can be converted between a bed configuration and a chair configuration. When in the bed configuration as shown in FIG. 1, the back section 15, the seat section 16, the thigh section 25, and each of the panels 21, 22 of the foot section 17 can cooperate to support the patient in a flat or supine position. In this configuration the patient is supported while laying flat on their back, and the foot section panels 21, 22 are oriented side by side and co-planar with the seat section 16 and with one another, to support the patient in a laying position. Typically the back section 15 may also be pivoted or positioned in relation to the seat section 16 to either allow the patient to lay completely flat, as well as to allow the patient to sit upright, for example in a standard Fowler's position.

Conversely, when the patient support surface 12 is utilized in a chair configuration, as shown in FIG. 2, the foot panels 21, 22 are pivoted upward and outward from their co-planar position on the frame 11 to assume a substantially parallel relationship, and revealing the space or clearing 18 at the foot of the bed for egress. In this configuration the foot panels 21, 22 no longer define part of the patient support surface 12, which now includes only the head/back section 15, the seat section 16, and the thigh section 25 (if present).

In addition to the guard rails 13, FIG. 2 also illustrates the inventive bed having footboards 41, 42 connected to each foot panel 21, 22, respectively. Like conventional guard rails 13, the footboards 41, 42 are also typically present on conventional hospital beds as well as the inventive bed, but were not illustrated in the embodiment shown in FIG. 1 in order to permit a better view of the various sections 15, 16, 25, 17 of the bed, as well as the retractable crossbar 20 which slides along the pair of lateral rails 23, 24 of the frame 11. Operation of the crossbar 20 will be explained in more detail below. Footboards have been found to be useful for patients with limited strength or mobility who may slide down in the bed because of gravity, or who may have difficulties sitting upright for a longer period of time. Footboards also discourage visitors from sitting on the end of the bed, which can cause the bed to tip. For the purposes of the present invention, the foot section 17 of the hospital bed can either include the footboards 41, 42 or not include footboards; typically patients and nurses prefer having them present.

As can be seen from comparing FIG. 1 to FIG. 2, the panels 21, 22 and their respective footboards 41, 42 can be pivoted from a substantially co-planar relationship (FIG. 1) to a relationship in which the first foot panel 21 and the second foot panel 22 are substantially upright/vertical and parallel to one another (FIG. 2). Looking at FIG. 2, the panels 21, 22 with their footboards 41, 42 are pivoted upward and outward via their pivotal connection with the lateral rails 23, 24 of the frame. Once in a substantially vertical position to expose the clearing 18 for the patient to stand, the panels 21, 22 can be locked into place and can provide a stable support which includes grab handles 26 for the patient to use when attempting to stand up. Those having ordinary skill in the art will appreciate that the grab handles 26 can be of any suitable shape, configuration, or arrangement sufficient to promote patient ambulation from the seated position.

The undersides of the panels 21, 22 can include integrated heel supports (not shown) which can advantageously allow for comfortable placement and securement of the patient's feet when the panels 21, 22 are in the raised or vertical configuration, i.e. the substantially parallel relationship. Heel supports are known in the art for use as stirrups for exposing the patient's groin area for cleaning, and/or positioning the patient for urinary catheterization, if needed. In addition, heel supports can be useful for comfortably holding the supine patient's feet and maneuvering their legs while moving the foot panels between the open and closed positions. The inclusion of heel supports in the inventive foot panels provides another advantageous use for the present invention, in addition to providing a safe clearing for standing and egress from the bed.

Figure 3:
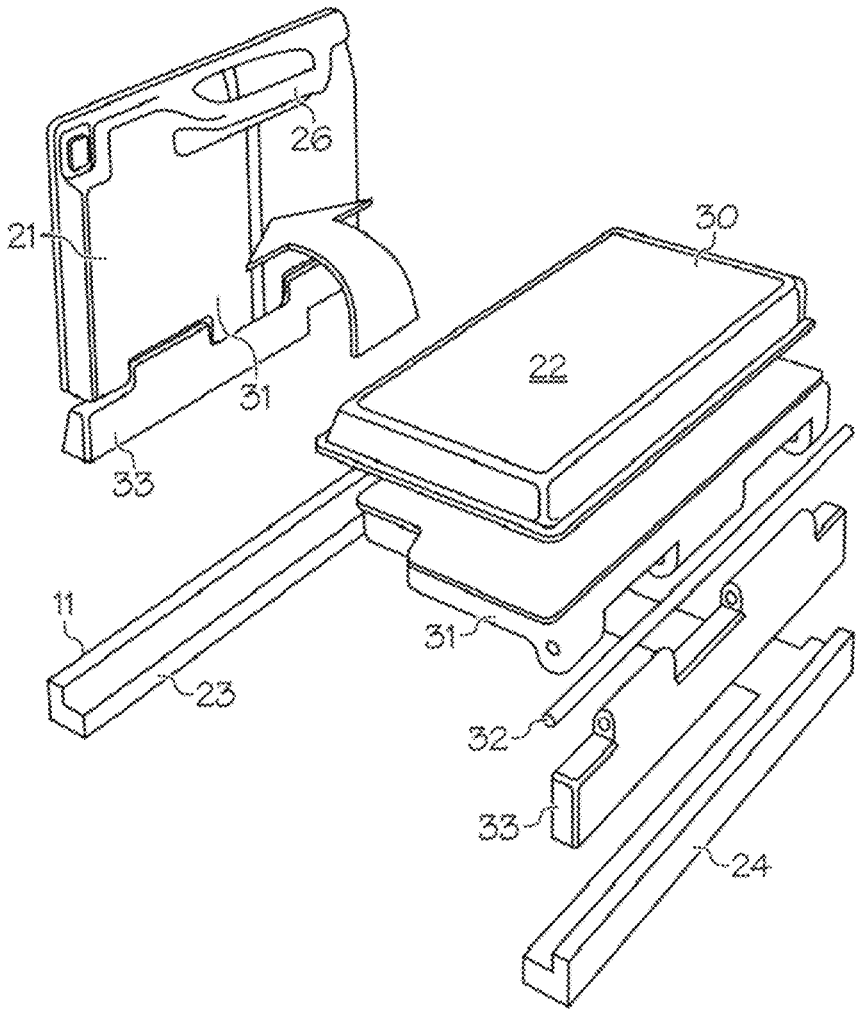
FIG. 3 illustrates a perspective and an exploded view of one embodiment of one of the foot panels of the hospital bed according to the present invention.

As shown in FIG. 3, the first foot panel 21 and the second foot panel 22 can be pivotably connected to the two opposing lateral rails 23, 24 at the foot end of the frame 11, each panel being pivotably attached to one of the rails 23, 24 by a pin 32 or other suitable pivoting mechanism known in the art. An exploded view of panel 22 in FIG. 3 shows one embodiment of the panel for use with the present invention, the panel 22 including a top mattress cap 30 and a hinged mechanism including an upper hinge knuckle 31, a pin 32, and a lower hinge knuckle 33. Each lower hinge knuckle 33 can attach to an opposing lateral rail 23, 24 of the frame and allow its panel to pivot upward relative to the seat section 16 as it rotates about the pin 32, the distal/inner portions of the previously co-planar panels 21, 22 moving upward and outward, away from one another, thus exposing the clearing 18 (when the crossbar 20 is retracted) for safe egress from the bed. The hinged mechanism can be designed such that the panel (21, as shown) can lock into place after being moved to a position in which the panels are substantially vertical. When both panels 21, 22 are vertical and locked they are also substantially parallel to one another, as can be seen in FIG. 2.

Figure 4A:
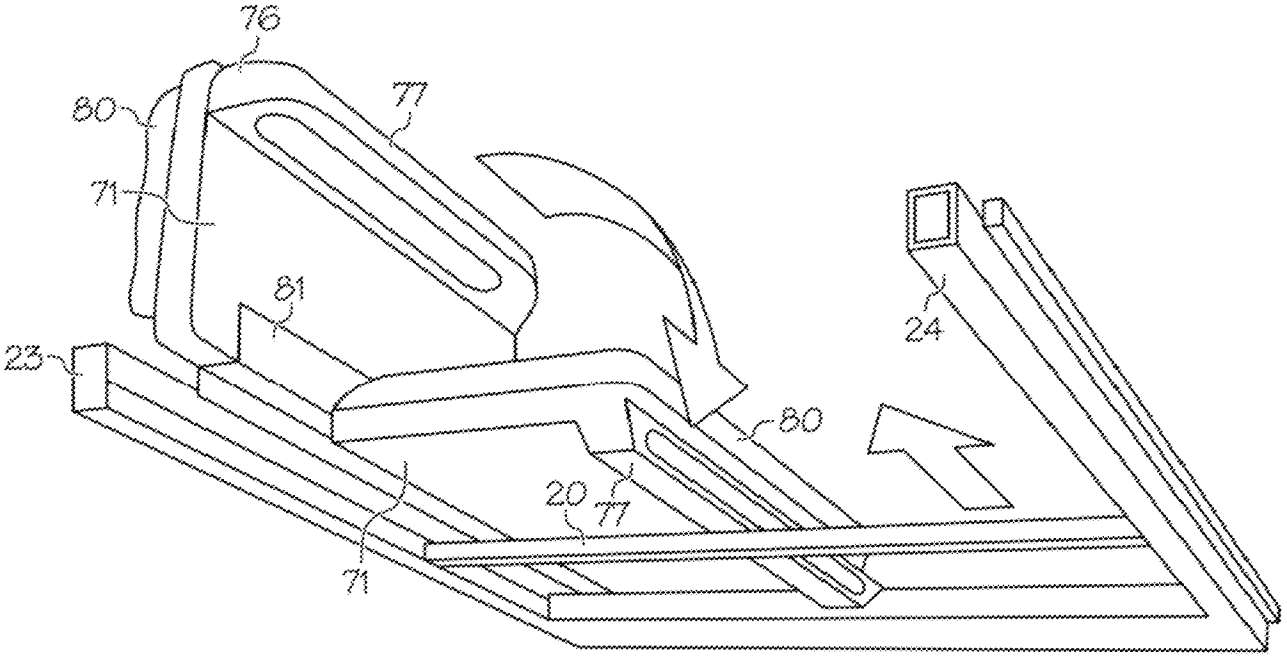
FIGS. 4A-4C illustrate various views of another embodiment of the foot panels of the hospital bed according to the present invention.
Figure 4C:
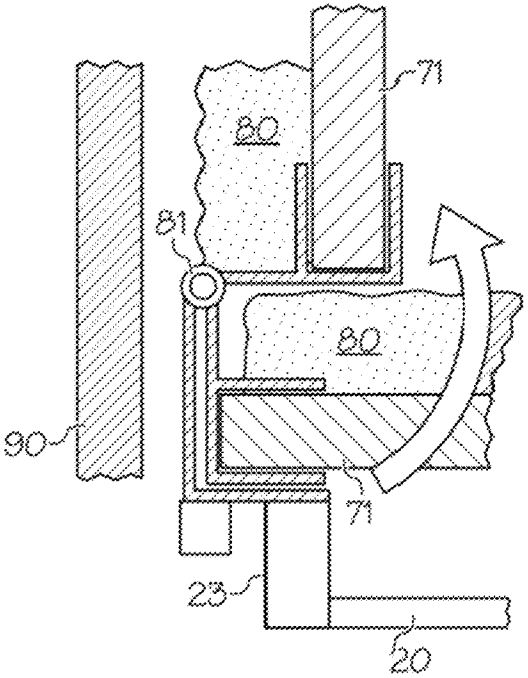
Figure 4B:
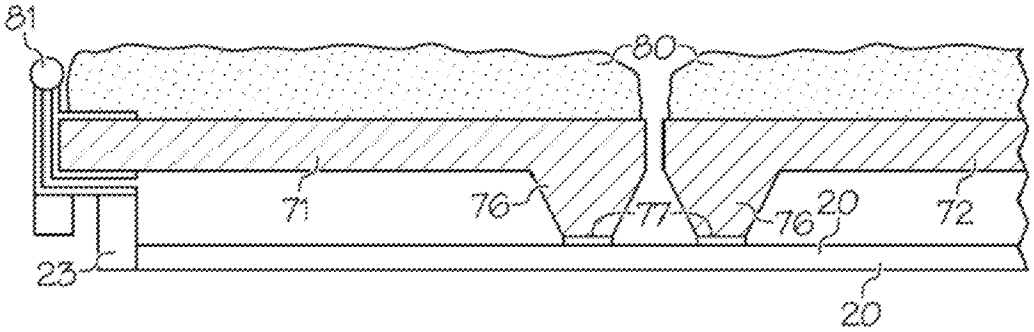

FIGS. 4A-4C illustrate another embodiment of the panels 71, 72 for use with the present invention. FIG. 4A shows an off-set pivot hinge 81 which is used to pivotably attach the panel 71 to the lateral rail 23. This off-set pivoting motion 82 swings the panel 71 and its foam top mattress cap 80 from a horizontal and/or substantially co-planar relationship with its mating panel 72 (see FIG. 4B) to a substantially vertical position (see FIG. 4C), to expose the clearing for the patient to stand. Once in this vertical position, as best seen in FIG. 4A, the panel 71 can provide a stable support which includes a grab handle 76 for the patient to use when attempting to stand up. Looking at FIG. 4B, when the panels 71, 72 are in a co-planar relationship (i.e. the bed configuration, as described above), the grab handles 76 are seated between the panels 71, 72 and the crossbar 20. Each of the grab handles 76 can include a slide bearing edge 77 as shown in FIG. 4B, which protects the handle 76 from wear and tear due the sliding of the crossbar 20 beneath it. Sliding movement of the crossbar 20 will be explained in more detail below.

FIG. 4C is a close-up view of the off-set pivot hinge of FIG. 4A in relation to a conventional hospital bed guard rail 90. It can be appreciated upon viewing FIG. 4C that the movement of the panel 71 from the horizontal position to the vertical position, as shown by the upward direction of the arrow, does not change the lateral profile of the bed. That is, raising of the panel does not cause any interference with the guard rail 90 on the outside of the bed. As a result, the panels 71, 72 can be raised to their upright, substantially parallel position without the guard rail 90 being blocked by the upright panels, thereby allowing the patient to use both the guard rails 90 as well as the grab handles 76, if needed. The downward curved arrow of FIG. 4A illustrates movement of the panel 71 from the vertical position to the horizontal position, causing the bearing edges 77 of the grab handles 76 to once again make contact the movable crossbar 20.

The retractable crossbar 20 disclosed herein is reversibly movable along the frame of the bed from an extended position under the foot section of the patient support surface to a retracted position beneath the seat section. Retraction of the crossbar 20 towards the center of the bed frame is necessary prior to or during the upward pivoting of the foot panels, to provide a safe clearing 18 for standing and egress from the foot end of the bed. Otherwise, the patient could easily injure themselves on the crossbar if it were not retracted. The retractable crossbar can be caused to move manually or by electronic-, hydraulic-, or pneumatic-operated means.

Figure 5:
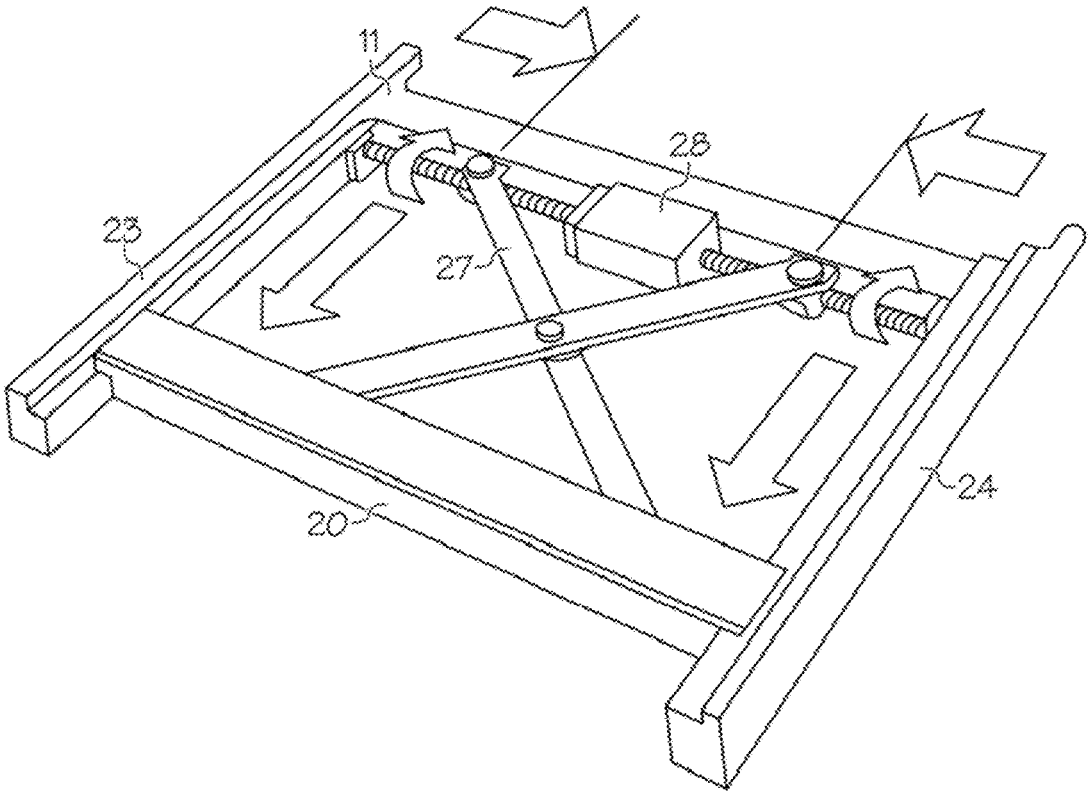
FIG. 5 illustrates one embodiment of a retracting means for the retractable crossbar.

FIG. 5 illustrates one embodiment of a relatively simple retracting means 27 for the crossbar 20. When in the extended position, the crossbar 20 is positioned beneath the foot section 17 of the support surface, at the distal foot end of the frame 11 to provide frame support for the foot panels and the patient's feet, i.e. when the patient is lying supine (see FIG. 1). The crossbar 20 can be drawn inward and become situated beneath the seat section 16 of the patient support surface (compare crossbar 20 location in FIG. 1 to FIG. 2). The retracting means 27 illustrated in FIG. 5 can be operated by an actuation mechanism 28, for reversibly moving the crossbar 20 inward and outward along the lateral rails 23, 24 of the frame 11. As a non-limiting example, if the actuation mechanism 28 is a small electrically powered motor, typically the motor can activate the retracting means 27 so that the crossbar 20 can be reversibly withdrawn beneath the seat section to create the clearing within about 4 seconds. Upon upward rotation and "opening" of the foot panels as described above the clearing is exposed, providing an easily accessible outlet for exiting the bed.

Figure 6:
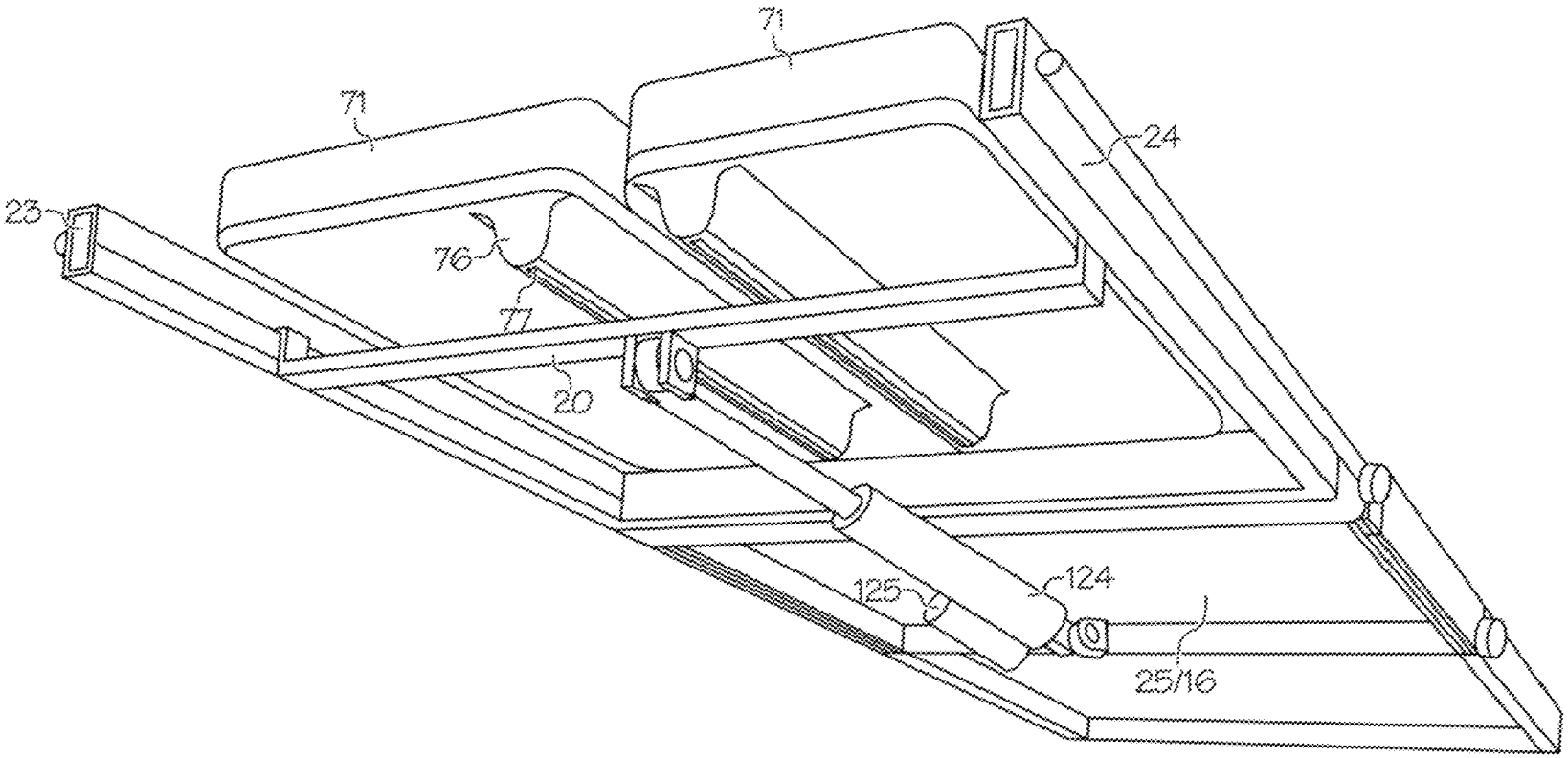
FIG. 6 illustrates another embodiment of the retracting means for the retractable crossbar in the form of an extension rod operated by a linear actuator.

FIG. 6 illustrates an embodiment of the retracting means in the form of an extension rod 124 which can be operated by a linear actuator 125, again such as a small motor, for reversibly moving the crossbar 20 inward and outward. The crossbar 20 is shown partially extended, as it slides along the lateral rails 23, 24 and beneath the bearing edges 77 of the grab handles 76. As noted above, the bearing edges 77 are intended to protect the grab handles 76 from wear and tear as they make contact with the frequently moving crossbar 20. The extension rod 124, activated by the linear actuator 125, can withdraw the crossbar 20 towards the center of the bed to expose the clearing. The panels 71, 72 can then be rotated upward and outward via their connection with the lateral rails 23, 24, being pivoted from a co-planar position as shown in FIG. 6 to a substantially parallel relationship as described herein, i.e. in an upright, vertical position, to expose the clearing.

Another embodiment of the retracting means (not shown) can be in the form of a linkage system which can be operated by a pair of actuators, for example, small motors which can reversibly move the crossbar inward and outward. Once the linkage system, activated by the small motors, has withdrawn the crossbar towards the center of the bed, the panels can be rotated upward and outward via their connection with the lateral rails from a co-planar position to a substantially parallel relationship to expose the clearing.

For safety purposes, the foot panels of the foot section can typically include a retention mechanism (not shown) which maintains the panels in a "closed", locked position, in co-planar abutment with each other and with the seat section (or the thigh section, if present), as is seen in the bed configuration. That is, when the foot panels are closed, a safety feature of the bed can include locking of the foot panels into this position and only permitting opening of the panels after the crossbar has been fully withdrawn into its retracted, stored position under the seat section of the bed. Therefore, the pair of foot panels should only be pivotable to reveal the clearing, and only pivotable in an upward direction, after the crossbar has first been fully retracted. As noted above, if the panels are opened before the crossbar has been retracted, then the patient could trip over the crossbar and be injured due to the crossbar blocking the path to egress. Also, it is important for safety reasons that the crossbar be in the fully extended position at the end of the frame when in the bed configuration. This is necessary to provide frame support for the patient's feet when lying supine, as well as support for a visitor who may choose to sit on the end of the bed (e.g. if there are no footboards). Once the crossbar is fully retracted, the foot panels can be upwardly pivoted to a substantially parallel relationship and locked into place to expose the clearing for standing and ambulation. The grab handles of the foot panels can now be accessed by the patient and used for support in standing.

Figure 7:
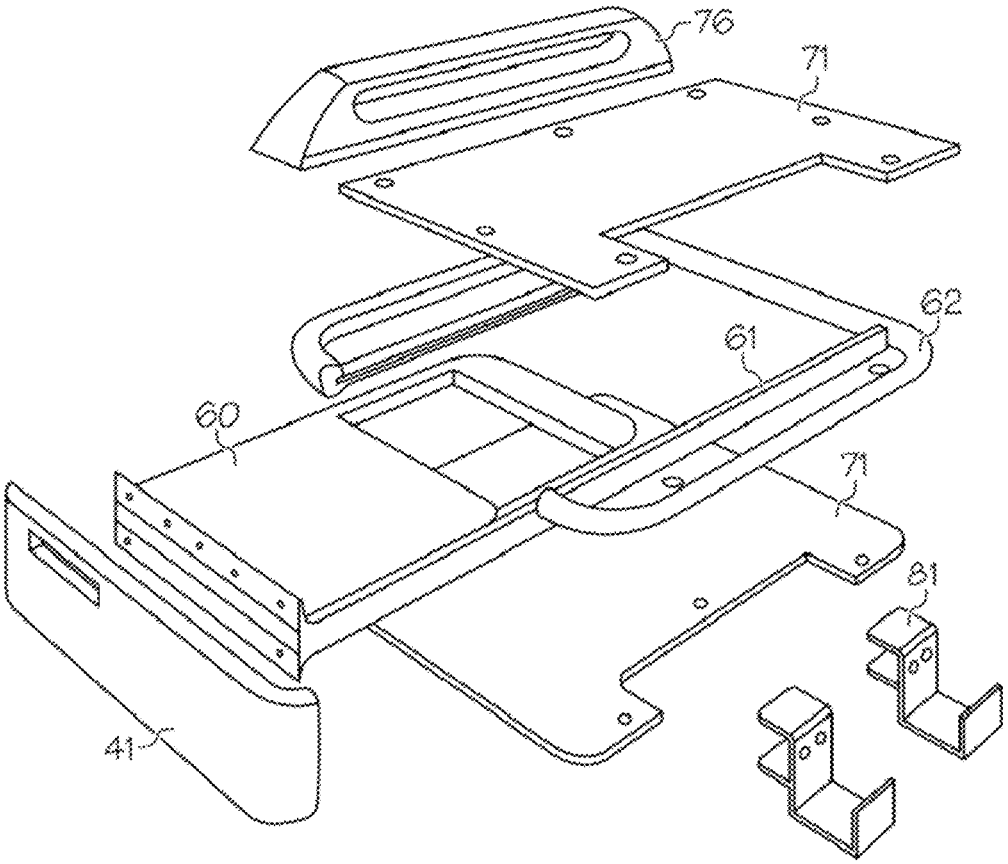
FIG. 7 illustrates an embodiment of one of the foot panels which includes a length extension assembly for tall patients.

FIG. 7 illustrates a length extension assembly 60 configured to adjust the foot section of the inventive bed between a first length and a second length, for tall patients. An exploded view of a foot panel 71 such as that shown if FIGS. 4A-4C further includes a deck extension assembly 60 located between top and bottom plates 71 of the panel. The deck extension assembly 60 can be moved with respect to the panel's plates 71 through actuation of a release handle (not shown), which allows the assembly 60 to slide along rails 61 which are slidably secured between supportive fittings 62 connecting the panel plates 71. Once released, the deck extension assembly 60 can be moved to its second length by pulling the footboard 41 out and sliding the assembly along the rails 61. This adjustment of the deck length provides for the accommodation of patients whose height necessitates a longer patient support.

The hospital bed disclosed herein advantageously makes it easier for patients to go from laying to sitting, and from sitting to standing, and also provides an improved manner of ingress and egress. It can be useful not only in the acute post-operative care setting, but also in long-term care facilities, as well as in home health care settings. The clearing created by the bed can be useful for nurses when helping patients such as the fragile, obese, or incontinent to get into and out of the bed, without the risk of falling that is attributable to conventional hospital beds. The clearing created at the foot of the bed can also provide a space to maneuver a scale, a bedside toilet, physical therapy equipment such as a walker, a wheelchair, or a mobile treadmill. Use of a conventional overbed table, also known as a bed table or a tilt top table, is also made much easier and safer. Overbed tables are intended to provide a steady surface while laying in a hospital bed, for example, for a patient to eat on or do office work on. The combination of the inventive bed with an overbed table can allow the patient to safely be seated at the foot of the bed while eating, with their feet safely on the floor, as opposed to having to lay in bed or sit at the side of the bed. For example, an overbed table can be safely loaded and locked in place by the lateral rails within the clearing at the distal foot end of the bed. In addition, when the patient is sitting in the clearing, the conventional guard rails do not need to be lowered to receive the overbed table, as required when the patient is sitting up in a conventional hospital bed. This is advantageous because often the guard rails are not restored to their upright position with convention overbed table use, leading to falls and injuries. Not having to lower the guard rails at all removes this risk.

While the present invention has been illustrated by the description of embodiments and examples thereof, it is not intended to restrict or in any way limit the scope of the appended claims to such details. Additional advantages and modifications will be readily apparent to those skilled in the art. Accordingly, departures may be made from such details without departing from the scope of the invention.

What is claimed is:

1. A hospital bed having foot egress, the bed comprising:

a) a frame, the frame including a first lateral rail, a second lateral rail, and a retractable crossbar; and b) a patient support surface supported by the frame, the support surface including:

i) a back section;

ii) a seat section; and iii) a foot section, the foot section comprising a first foot panel and a second foot panel, the first foot panel being pivotably connected by a first hinged mechanism to the first lateral rail and the second foot panel being pivotably connected by a second hinged mechanism to the second lateral rail, wherein the first hinged mechanism includes a first pin for allowing rotation of the first foot panel about the first pin, and wherein the second hinged mechanism includes a second pin for allowing rotation of the second foot panel about the second pin;

wherein the retractable crossbar is reversibly movable along the opposing lateral rails between an extended position in which the crossbar is beneath the foot section and a retracted position in which the crossbar is beneath the seat section, wherein the first foot panel and second foot panel are each upwardly pivotable through their connection with the first and second lateral rails, respectively, from a horizontal position in which the first and second foot panels are in a substantially co-planar relationship to a vertical position in which the first and second foot panels are in a substantially parallel relationship, and wherein a clearing for egress from the bed is exposed and the first and second foot panels provide a stable support for the patient to use to stand up when the retractable crossbar is in the retracted position and the first and second foot panels are in the substantially parallel relationship.

2. The hospital bed of claim 1, wherein each of the first foot panel and the second foot panel are upwardly pivotable only when the retractable crossbar is in the retracted position.

3. The hospital bed of claim 1, wherein the first foot panel and the second foot panel are configured to lock into place after being pivoted to the substantially parallel relationship.

4. The hospital bed of claim 1, wherein the first foot panel and the second foot panel each include integrated heel supports for placement and securement of the patient's feet when the foot panels are in the substantially parallel relationship.

5. The hospital bed of claim 1, wherein the first foot panel and the second foot panel each include a grab handle for assistance in standing and ambulation.

6. The hospital bed of claim 5, wherein each grab handle comprises a slide bearing edge for making sliding contact with the retractable crossbar when the first foot panel and the second foot panel are in the substantially co-planar relationship.

7. The hospital bed of claim 1, further including a retracting means for reversibly moving the crossbar along the opposing lateral rails.

8. The hospital bed of claim 1, wherein each hinged mechanism is an off-set pivot hinge.

9. The hospital bed of claim 1, wherein the foot panels include a length extension assembly configured to adjust between a first length and a second length.

10. A hospital bed with foot egress, the bed comprising:

a) a frame including a first lateral rail, a second lateral rail, and a retractable crossbar; and b) a patient support surface coupled to the frame and including a seat section and a foot section, the foot section comprising a first foot panel and a second foot panel, wherein each of the first foot panel and the second foot panel include a grab handle for assistance in standing and ambulation, wherein the retractable crossbar is reversibly movable along the frame from an extended position beneath the foot section to a retracted position beneath the seat section, and wherein the first foot panel and the second foot panel are each upwardly pivotable relative to the seat section and away from one another to expose a clearing for egress from the bed, wherein the first foot panel and the second foot panel are each connected by a hinged mechanism to the opposing first lateral rail and second lateral rail of the frame, respectively, wherein each hinged mechanism includes a pin for allowing rotation of the foot panel about the pin, and wherein the first and second foot panels are reversibly pivotable through their connection with the first and second lateral rails, respectively, from a horizontal position in which the foot panels are in a substantially co-planar relationship to a vertical position in which the foot panels are in a substantially parallel relationship.

11. The hospital bed of claim 10, wherein each hinged mechanism is an off-set pivot hinge.

12. The hospital bed of claim 10, wherein the clearing for egress from the bed is exposed and the first and second foot panels provide a stable support for the patient to use to stand up when the retractable crossbar is in the retracted position and the first foot panel and the second foot panel are in the substantially parallel relationship.

13. The hospital bed of claim 10, wherein each of the first foot panel and the second foot panel is configured to lock into place after being pivoted to the substantially parallel relationship.

14. The hospital bed of claim 10, wherein each of the first foot panel and the second foot panel include integrated heel supports for placement and securement of the patient's feet when the panels are in the substantially parallel relationship.

15. The hospital bed of claim 10, further including a retracting means for reversibly moving the crossbar along the frame.

16. A hospital bed having foot egress, the bed comprising:

a) a frame, the frame including a retractable crossbar movable along a first lateral rail and a second lateral rail, the lateral rails opposing one another; and b) a patient support surface supported by the frame, the support surface including a back section, a seat section, a thigh section, and a foot section, the foot section comprising a first foot panel and a second foot panel, the first foot panel being pivotably connected by a first hinged mechanism to the first lateral rail and the second foot panel being pivotably connected by a second hinged mechanism to the second lateral rail, wherein the first hinged mechanism includes a first pin for allowing rotation of the first foot panel about the first pin, and wherein the second hinged mechanism includes a second pin for allowing rotation of the second foot panel about the second pin, wherein the retractable crossbar is reversibly movable along the opposing lateral rails between an extended position in which the crossbar is beneath the foot section and a retracted position in which the crossbar is beneath the thigh section, wherein each of the first foot panel and the second foot panel are upwardly pivotable through their connection with the first and second lateral rails, respectively, from a horizontal position in which the first and second foot panels are in a substantially co-planar relationship to a vertical position in which the first and second foot panels are in a substantially parallel relationship when the retractable crossbar is in the retracted position, wherein each of the first foot panel and the second foot panel include a grab handle for assistance in standing and ambulation and are configured to lock into place after being pivoted to the substantially parallel relationship, and wherein a clearing for egress from the bed is exposed and the first and second foot panels provide a stable support for the patient to use to stand up when the retractable crossbar is in the retracted position and the first and second foot panels are in the substantially parallel relationship.

17. The hospital bed of claim 16, wherein each grab handle comprises a slide bearing edge for making sliding contact with the retractable crossbar when the first foot panel and the second foot panel are in the substantially co-planar relationship.

18. The hospital bed of claim 16, further including a retracting means for reversibly moving the crossbar along the opposing lateral rails.

* * * * *